US008944644B2

(12) United States Patent
Kuo

(10) Patent No.: US 8,944,644 B2
(45) Date of Patent: Feb. 3, 2015

(54) LENS MODULE AND LED ILLUMINATION DEVICE USING THE SAME

(75) Inventor: Hung-Pin Kuo, Taichung (TW)

(73) Assignee: B&M Optics Co., Ltd., Taichung County (TW)

( * ) Notice: Subject to any disclaimer, the term of this patent is extended or adjusted under 35 U.S.C. 154(b) by 660 days.

(21) Appl. No.: 12/885,954

(22) Filed: Sep. 20, 2010

(65) Prior Publication Data

US 2011/0085329 A1 Apr. 14, 2011

(30) Foreign Application Priority Data

Oct. 9, 2009 (TW) ..... 98134432 A

(51) Int. Cl.

| | |
|---|---|
| ***F21V 3/00*** | (2006.01) |
| ***F21V 5/00*** | (2006.01) |
| ***F21V 17/16*** | (2006.01) |
| *F21V 3/04* | (2006.01) |
| *F21Y 101/02* | (2006.01) |
| *F21Y 105/00* | (2006.01) |

(52) U.S. Cl.

CPC ..... *F21V 5/007* (2013.01); *F21V 17/16* (2013.01); *F21V 3/04* (2013.01); *F21Y 2101/02* (2013.01); *F21Y 2105/001* (2013.01)

USPC ..... 362/311.02; 362/235; 362/326; 362/244

(58) Field of Classification Search

USPC ..... 362/800, 311.01–311.15, 244, 235, 326

See application file for complete search history.

(56) References Cited

U.S. PATENT DOCUMENTS

| | | | | |
|---|---|---|---|---|
| 8,083,380 | B2 * | 12/2011 | Zhou | 362/311.02 |
| 2009/0034269 | A1 * | 2/2009 | Li | 362/332 |
| 2009/0237942 | A1 * | 9/2009 | Lam et al. | 362/308 |
| 2010/0118550 | A1 * | 5/2010 | Kuo | 362/311.02 |
| 2011/0103051 | A1 * | 5/2011 | Wilcox et al. | 362/235 |

FOREIGN PATENT DOCUMENTS

| | | |
|---|---|---|
| TW | M345181 U | 11/2008 |

* cited by examiner

*Primary Examiner* — Anh Mai
*Assistant Examiner* — Jessica M Apenteng
(74) *Attorney, Agent, or Firm* — Muncy, Geissler, Olds & Lowe, P.C.

(57) ABSTRACT

This invention relates to a lens module and a LED illumination device using the same. The lens module includes a plurality of lens units and a plate. Each of the lens units includes a lens body, a first engaging structure and a second engaging structure. The lens body has a light incident surface at a top thereof and a light exit surface at a bottom thereof. The first and second engaging structures are arranged at peripheral edges of the lens body. On the other hand, the plate defines a plurality of seats for accommodating the lens units. Each of the seats includes an aperture from top to bottom of the plate to receive the respective lens body of the lens unit, a supporting structure arranged at peripheral edge of the aperture of the seat to engage with the respective first engaging structure of the lens in order to prevent the lens unit from falling off the seat, and a suppressing structure arranged at peripheral edge of the aperture of the seat to engage with the second engaging structure of the lens in order to prevent the lens unit from upward withdrawal of the seat.

16 Claims, 6 Drawing Sheets

LENS MODULE AND LED ILLUMINATION DEVICE USING THE SAME

BACKGROUND OF INVENTION

1. Field of Invention

The present invention relates to a lens module and a LED illumination device using the same, and in particular to a lens module which can be effectively assembled.

2. Related Prior Art

Light-emitting diodes (LED) are widely used in illumination devices. As shown in Taiwan Patent No. M345181, a LED lighting device generally comprises a LED array and a lens array. The lens array includes a plurality of individual lenses each mounted in a respective hole of a plate and corresponding to the respective light emitting diode of the LED array so as to guide the light rays emitted from the LEDs to desired directions. Specifically, the lenses of the lens array are secured in the respective holes of the plate by the use of adhesive materials, and this causes the assembly of such a LED lighting device to be a costly and time-consuming process. Moreover, the adhesive bonding may decay because of the heat generated by the LEDs and causes the lenses to drop off the plate after a long time of use.

SUMMARY OF INVENTION

Broadly stated, the present invention is directed to a lens module and a LED illumination device using the same. The lens module includes a plurality of lens units and a plate. Each of the lens units includes a lens body, a first engaging structure and a second engaging structure. The lens body has a light incident surface at a top thereof and a light exit surface at a bottom thereof. The first and second engaging structures are arranged at peripheral edges of the lens body. On the other hand, the plate defines a plurality of seats for accommodating the lens units. Each of the seats includes an aperture from top to bottom of the plate to receive the respective lens body of the lens unit, a supporting structure arranged at peripheral edge of the aperture of the seat to engage with the respective first engaging structure of the lens in order to prevent the lens unit from falling off the seat, and a suppressing structure arranged at peripheral edge of the aperture of the seat to engage with the second engaging structure of the lens in order to prevent the lens unit from upward withdrawal of the seat.

According to the above, each of the lens units can be effectively mounted in the respective seat of the plate without the use of adhesive materials. The construction of lens module as described above is thus far largely conventional and is advantageously utilized to simply the manufacture process.

Further features and advantages of the present invention will be appreciated by review of the following detailed description of the invention.

BRIEF DESCRIPTION OF DRAWINGS

The invention is illustrated by the accompanying drawings in which corresponding parts are identified by the same numerals and in which.

DETAILED DESCRIPTION OF PREFERRED EMBODIMENT

Figure 3:
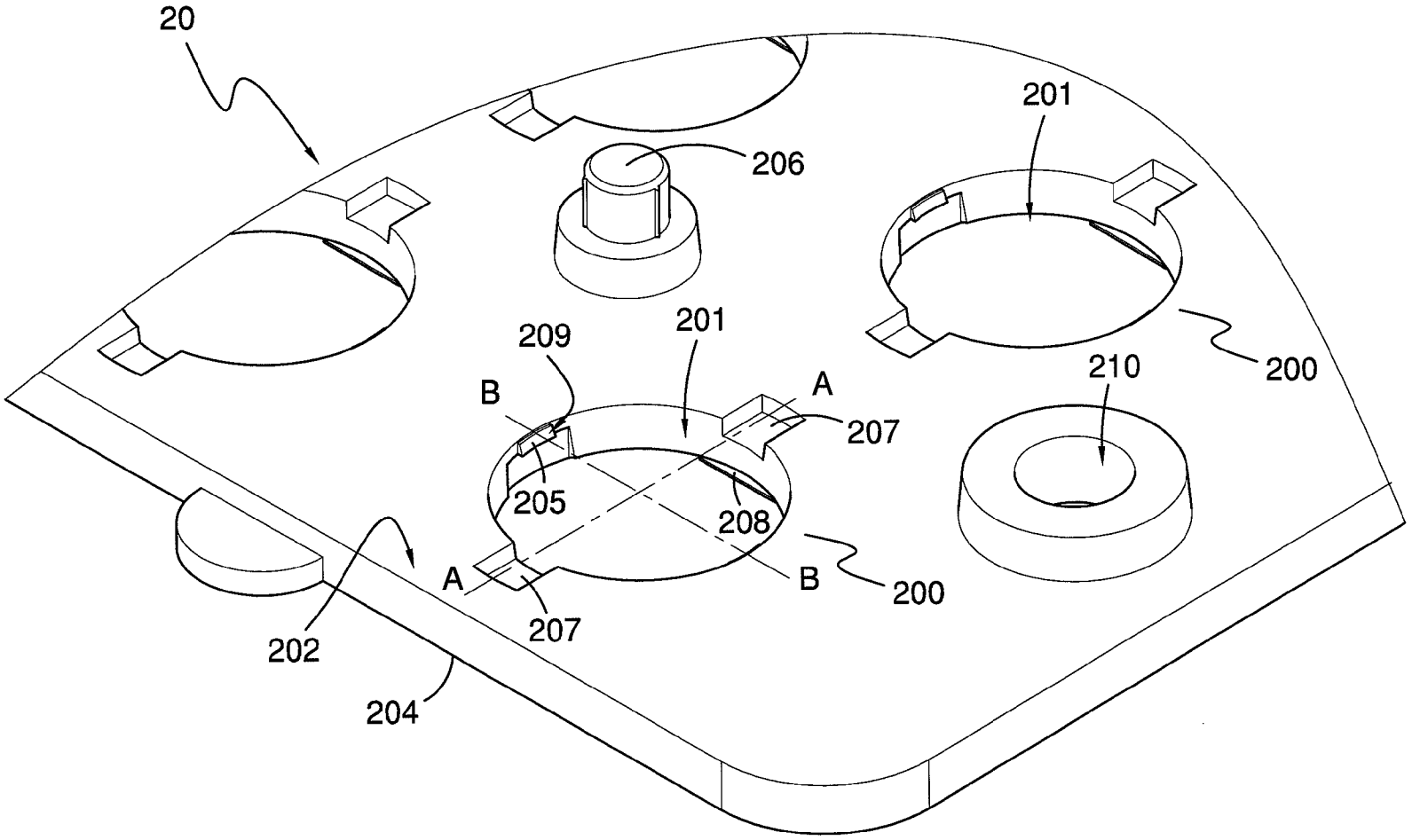
FIG. 3 is a partial top side view of a plate of the lens module in FIG. 1.
Figure 4:
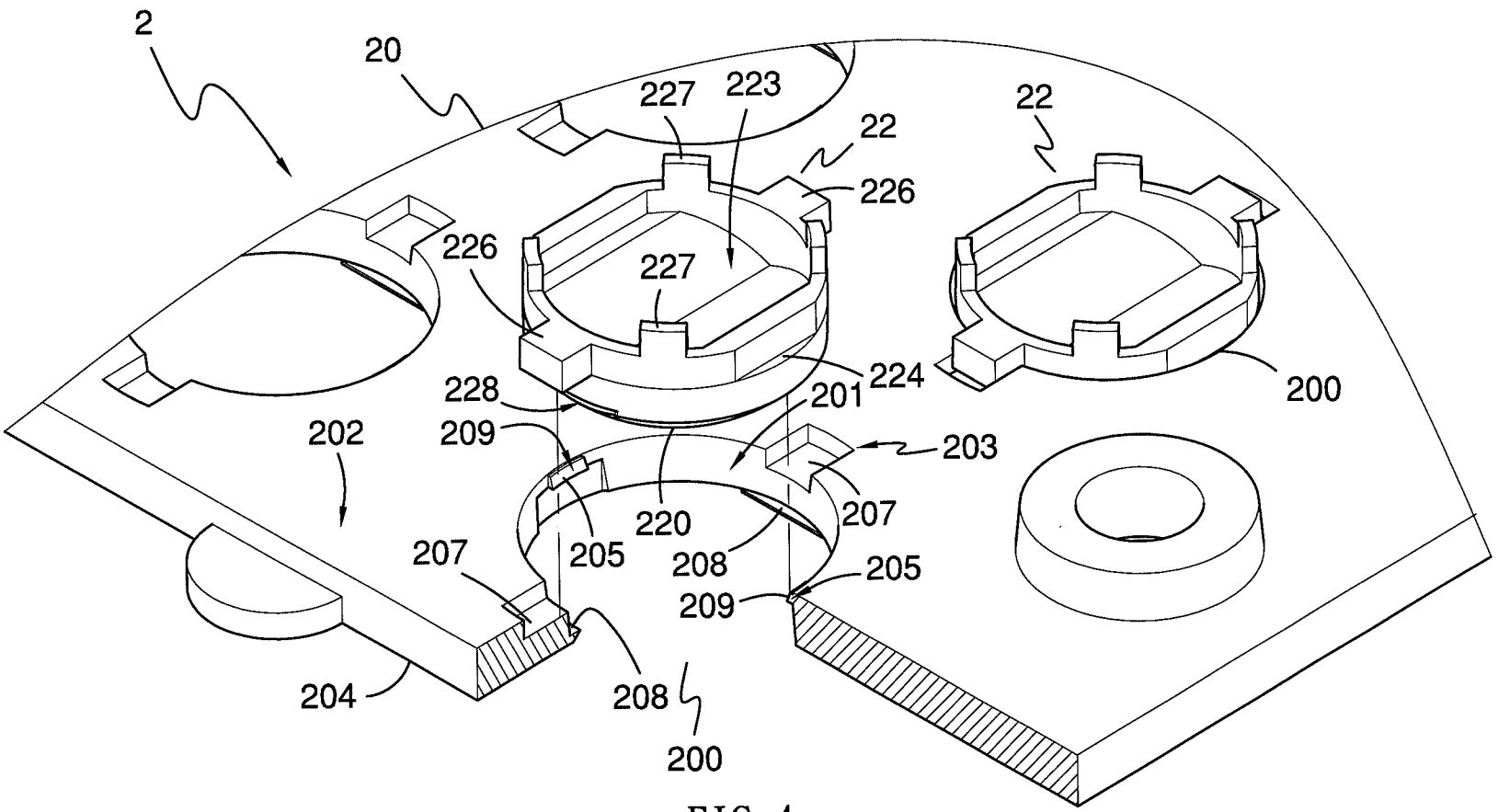
FIG. 4 is a view similar to FIG. 3, partially broken away to show details of construction, of the plate.
Figure 5:
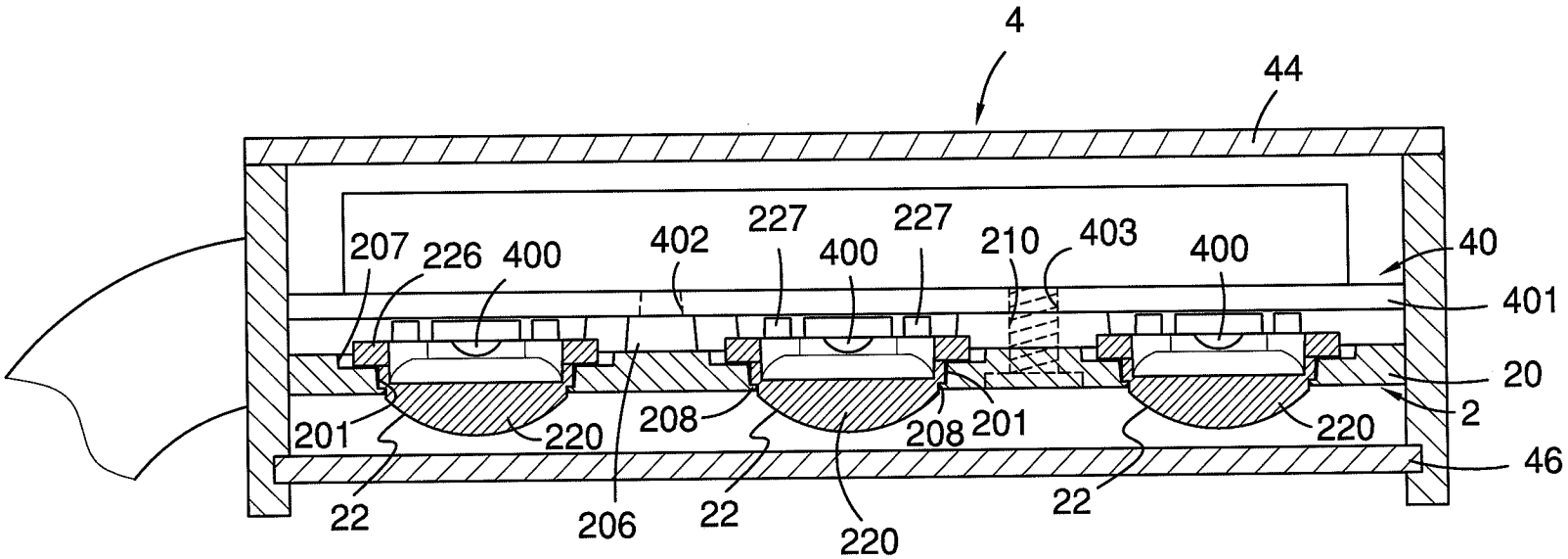
FIG. 5 is a cross section of a LED illumination device using the lens module taken along the line A-A in FIG. 3.
Figure 6:
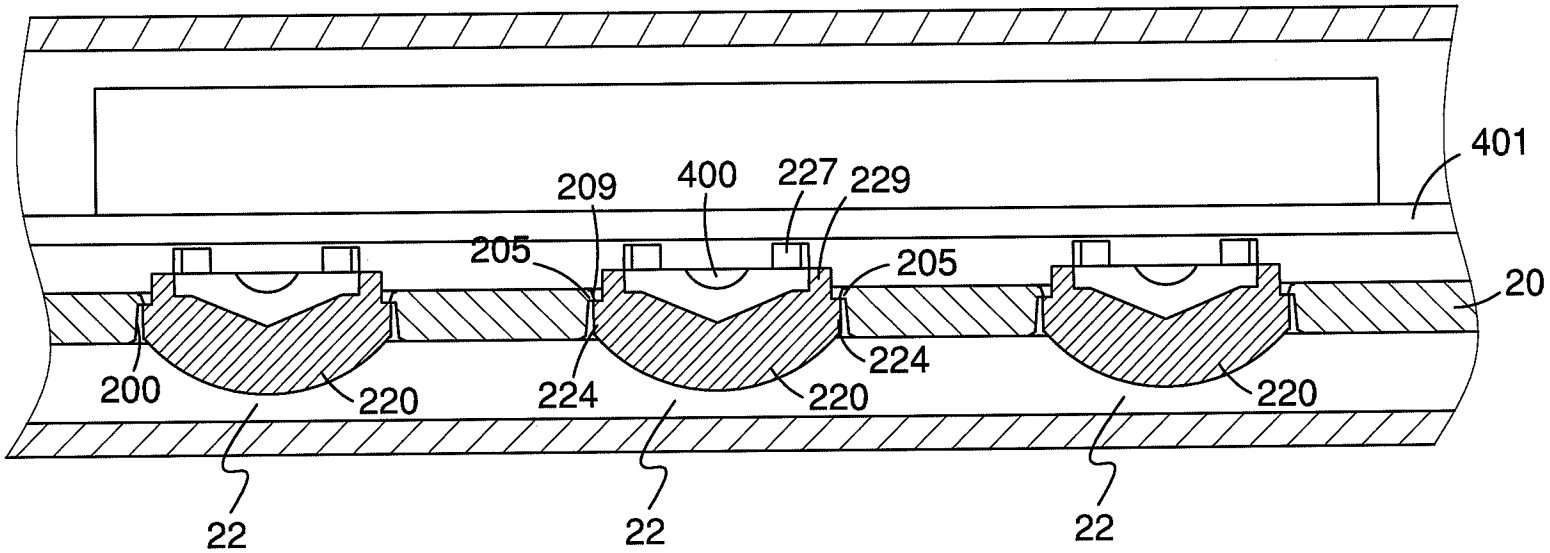
FIG. 6 is another cross section of a LED illumination device using the lens module taken along the line B-B in FIG. 3.

Referring now to FIGS. 1-4 of the drawings, a lens module 2 is illustrated in accordance with the preferred embodiment of the invention. FIGS. 5 and 6 illustrate a LED illumination device 4 equipped with the lens module 2 according to the invention.

Figure 1:
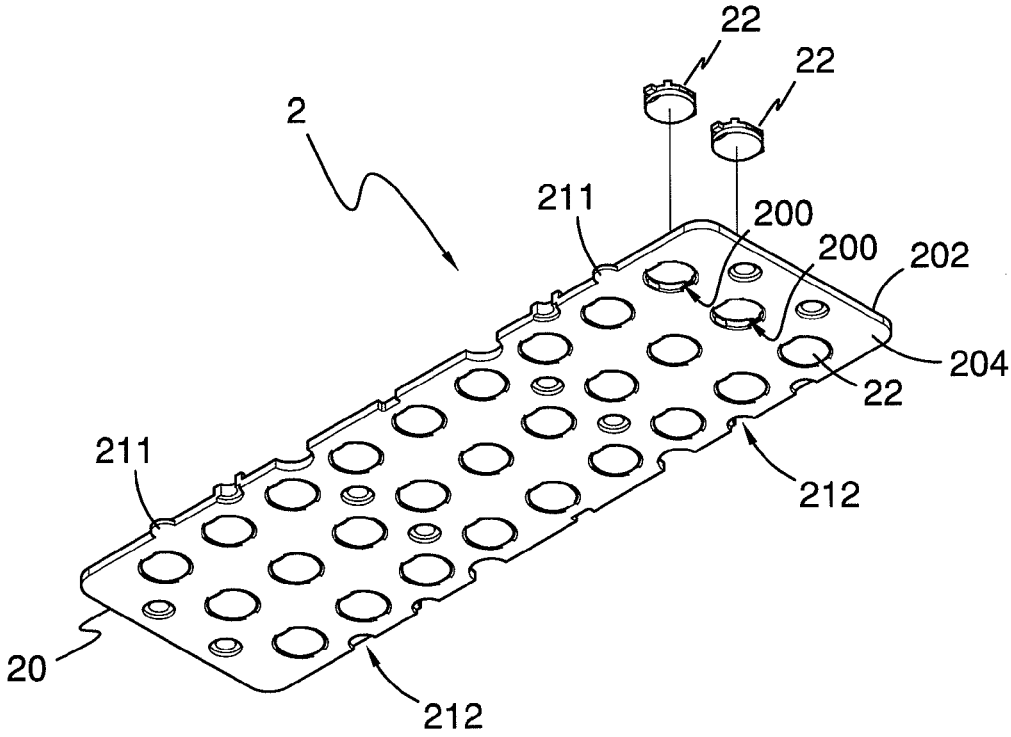
FIG. 1 is an exploded view of a lens module in accordance with the preferred embodiment of the invention.

As shown in FIG. 1, the lens module 2 includes a plate 20 and a plurality of lens units 22. The plate 20 has a top surface 202 and a bottom surface 204 and defines a plurality of seats 200 for accommodating the lens units 20. To assemble the lens module 2, the lens units 22 are pressed down from the top into the respective seats 200 of the plate 20.

Figure 2:
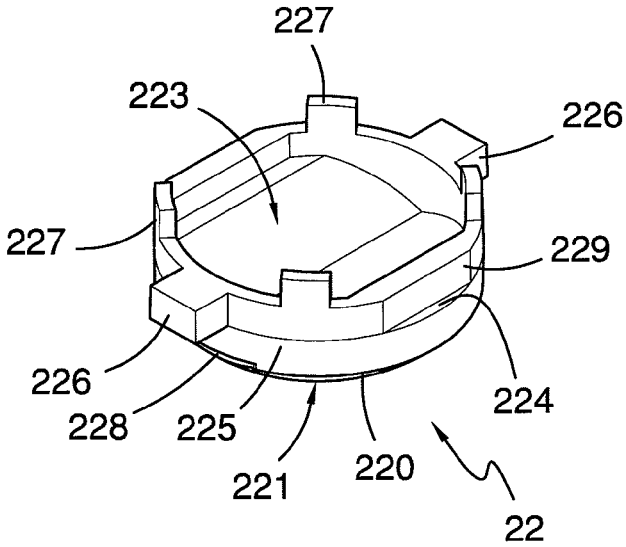
FIG. 2 is a perspective view of a lens unit of the lens module in FIG. 1.

FIG. 2 is an enlarged top side view of one of the lens units 22. Each of the lens units 22 includes a lens body 220 having a light incident surface 223 at a top thereof and a light exit surface 221 at a bottom thereof. The lens unit 22 further includes a first engaging structure and a second engaging structure at peripheral edges of the lens body 220 for engagement with the plate 20. In this embodiment, the first engaging structure of the lens unit 22 includes a frame 229 formed on a peripheral edge of the top incident surface 223 of the lens body 220 and two lugs 226 formed on opposite sides of the frame 229. The second engaging structure of the lens unit 22 includes two extensions 224 formed on opposite sides of the lens body 220 and extending outside the frame 229 of the first engaging structure.

The plate 20 of the lens module 2 is preferably made of acrylic sheet or glass sheet that is transparent or semi-transparent. As best seen in FIGS. 3 and 4, each of the seats 200 of the plate 20 defines an aperture 201 from top to bottom of the plate 20 for reception of the respective lens body 220 of the lens unit 22. Moreover, the seat 200 includes a supporting structure and a suppressing structure arranged at peripheral edges of the aperture 201. In this embodiment, the supporting structure of the seat 200 includes two notches 207 at opposite sides of the aperture 201 and in the top surface 202 of the plate 20 for reception of the two lugs 226 of the first engaging structure of the lens unit 22. By virtue of the coupled lugs 226 and the notches 207, the first engaging structure of the lens unit 22 and the supporting structure of the seat 200 are engaged to prevent the lens unit 22 from falling off the seat 200 of the plate 20, as shown in FIG. 5. By the way, the engagement of the lugs 226 and the notches 207 also prevents rotation of the lens unit 22 within the seat 200 of the plate 2.

Referring to FIGS. 3 and 4, the suppressing structure of the seat 200 includes two opposite blocks 205 protruding from an interior wall of the aperture 201 of the seat 200. Each of the blocks 205 has a top sloping surface 209 for guiding the respective extension 224 of the second engaging structure of the lens unit 22 into the aperture 201 of the seat 200. As depicted in FIG. 6, the lens unit 22 can be pressed from the top of the plate 20 into the seat 200 where the two opposite blocks 205 keep the extensions 224 of the lens unit 22 from upward withdrawal. By virtue of the blocks 205 and the extensions 224, the suppressing structure of the seat 200 and the second engaging structure of the lens unit 22 are engaged to prevent the lens unit 22 from upward withdrawal of the seat 200 of the plate 20.

In addition, as shown in FIG. 4, the first engaging structure of the lens unit 22 further includes two recesses 228 in opposite side edges of the lens body 220. The supporting structure of the seat 200 further includes two projecting portions 208 at opposite sides of the aperture 201 of the seat 200. As seen in FIG. 5, the projecting portions 208 of the supporting structure of the seat 200 are wedged in the respective recesses 228 of the first engaging structure of the lens unit 22. By virtue of the coupled the projecting portions 208 and the recesses 228, the first engaging structure of the lens unit 22 and the supporting structure of the seat 200 can also be engaged to prevent the lens unit 22 from falling off the seat 200. By the way, the engagement of the projecting portions 208 and the recesses 228 also prevents rotation of the lens unit 22 within the seat 200 of the plate 20.

Referring to FIG. 5, the LED illumination device 4 includes a casing 44, a LED module 40, the aforementioned lens module 2 and a bottom cover 46. The LED module 40 and the lens module 2 are housed inside the casing 44. The bottom cover 46 is mounted in an opening of the casing 44 to cover the LED module 40 and the lens module 2. The LED module 40 includes a circuit board 401 and a plurality of LED packages 400 mounted on the circuit board 401. Each of the LED packages 400 has a light emitting surface facing down toward the respective light incident surface 223 of the lens body 220 of the lens unit 22.

For convenient assembly, the plate 20 of the lens module 2 is formed with a plurality of pillars 206, as best seen in FIG. 3, on the top surface 202 thereof for insertion into corresponding holes 402 defined in a bottom surface of the circuit board 401 of the LED modules 40, as shown in FIG. 5, in order to position the plate 20 onto the bottom surface of the circuit board 401. Also, the plate 20 defines a plurality of screw holes 210 from top to bottom thereof for insertion of screws into corresponding holes 403 of the circuit board 401 of the LED modules 40 for securing the plate 20 onto the bottom surface of the circuit board 401. On the other hand, the first engaging structure of the lens unit 22, as shown in FIG. 2, further includes a plurality of posts 227 each extending upward from the frame 229 and abutting against the bottom surface of the circuit board 401 of the LED modules 40.

Figure 7:
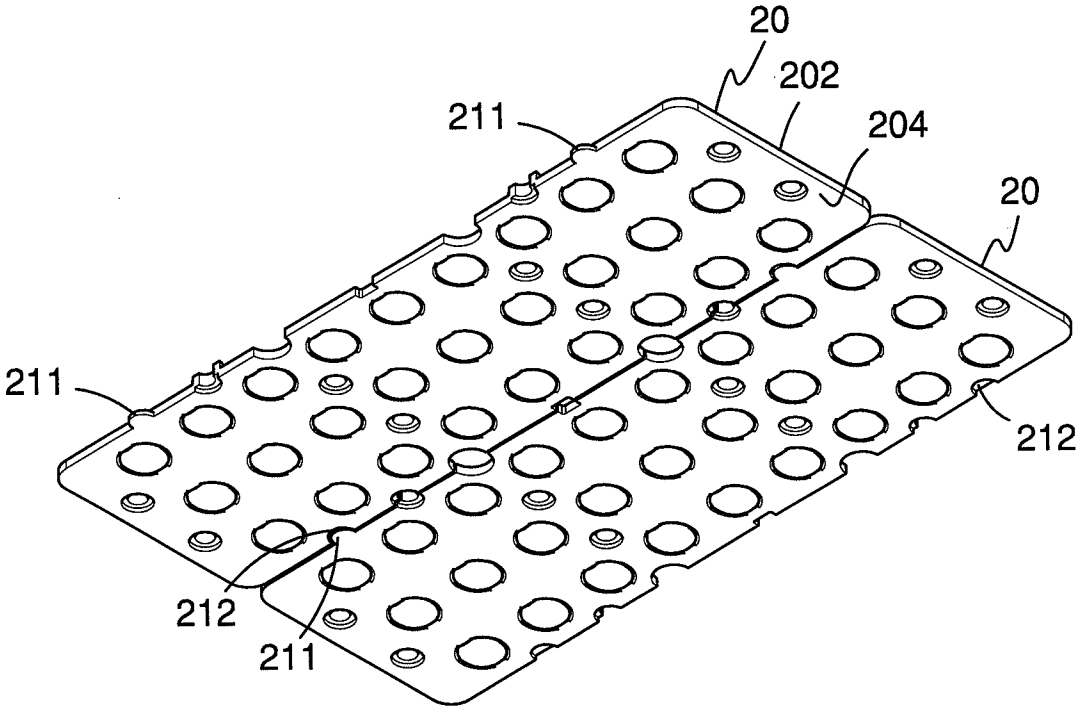
FIG. 7 shows that the plate of FIG. 1 is engaged with another identical plate.

Referring back to FIG. 1, the plate 20 further includes at least one protrusion 211 and at least one indentation 212 at opposite edges thereof. This configuration enables the plate 20 to be assembled with another plate 20 side by side, as shown in FIG. 7, to become a larger lens module assembly, which could be employed for a relatively large-sized illumination device.

According to the above, each of the lens units can be effectively mounted in the respective seat of the plate without the use of adhesive materials, and the lens module can be effectively mounted onto the bottom of the LED modules to form the LED illumination device. The construction of lens module as well as the LED illumination device described above is thus far largely conventional and is advantageously utilized to simply the manufacture process.

It will be appreciated that although a particular embodiment of the invention has been shown and described, modifications may be made. It is intended in the claims to cover such modifications which come within the spirit and scope of the invention.

The invention claimed is:

1. A lens module comprising:

a plate defining a plurality of seats; each seat comprising an aperture passing through from a top surface of the plate to a bottom surface of the plate, a supporting structure arranged on the top surface of the plate and at peripheral edge of the aperture of the seat having two notches at opposite sides of the aperture of the seat, and a suppressing structure having two opposite blocks protruding from an interior wall of the aperture; and a plurality of lens units each fixed on the respective seat of the plate, each comprising a lens body, a first engaging structure and a second engaging structure; the lens body received in the aperture of the respective seat of the plate having a light incident surface at a top thereof and facing the same direction as the top surface of the plate, a light exit surface at a bottom thereof facing the same direction as the bottom surface of the plate; the first engaging structure comprising a frame formed on a peripheral edge of the top incident surface of the lens body and two lugs formed on opposite sides of the frame the second engaging structure arranged at the peripheral edges of the lens body comprising two extensions formed on opposite sides of the lens body and extending outside the frame of the first engaging structure, wherein the two notches receive the two lugs respectively thereon and blocks the lugs from moving and rotating so as to keep the lens unit from coming off towards the direction that the light exit surface faces; wherein the two extensions of the second engaging structure are blocked by the two opposite blocks of the suppressing structure to prevent the lens unit from coming off towards the direction that the light incident faces.

2. The lens module of claim 1, wherein the blocks abutting against the extensions and stopping the lens unit from upwardly moving; each block of the suppressing structure has a top sloping surface for guiding the respective extension of the second engaging structure of the lens unit into the aperture of the seat.

3. The lens module of claim 2, wherein the first engaging structure of the lens unit further includes a plurality of posts each extending upward from the frame and parallel to the axis of the lens body.

4. The lens module of claim 3, wherein the plate further includes at least one protrusion and at least one indentation at opposite edges thereof.

5. The lens module of claim 1, wherein the first engaging structure of the lens unit includes two recesses in opposite side edges of the lens body; and the supporting structure of the seat includes two projecting portions at opposite sides of the aperture of the seat to be wedged in the recesses of the first engaging structure of the lens unit.

6. The lens module of claim 5, wherein the blocks abutting against the extensions and stopping the lens unit from upwardly moving; each block has a top sloping surface for guiding the respective extension of the second engaging structure of the lens unit into the aperture of the seat.

7. The lens module of claim 6, wherein the first engaging structure of the lens unit further includes a plurality of posts each extending upward from the frame and parallel to the axis of the lens body.

8. The lens module of claim 7, wherein the plate further includes at least one protrusion and at least one indentation at opposite edges thereof.

9. A LED illumination device comprising a LED module and a lens module of claim 1, wherein the LED modules includes a circuit board and a plurality of LED packages mounted on a bottom surface of the circuit board; the bottom surface of the circuit board faces the top surface of the plate; and each of LED packages has a light emitting surface facing toward the respective light incident surface of the lens body of the lens unit.

10. The LED illumination device of claim 9, wherein the blocks abutting against the extensions and stopping the lens unit from upwardly moving; each block has a top sloping surface for guiding the respective extension of the second engaging structure of the lens unit into the aperture of the seat.

11. The LED illumination device of claim 10, wherein the first engaging structure of the lens unit further includes a plurality of posts each extending downward from the frame and parallel to the axis of the lens body.

12. The LED illumination device of claim 11, wherein the plate further includes at least one protrusion and at least one indentation at opposite edges thereof.

13. The LED illumination device of claim 9, wherein the first engaging structure of the lens unit includes two recesses in opposite side edges of the lens body; and the supporting structure of the seat includes two projecting portions at opposite sides of the aperture of the seat to be wedged in the recesses of the first engaging structure of the lens unit.

14. The LED illumination device of claim 13, wherein the blocks abutting against the extensions and stopping the lens unit from upwardly moving; each block has a top sloping surface for guiding the respective extension of the second engaging structure of the lens unit into the aperture of the seat.

15. The LED illumination device of claim 14, wherein the first engaging structure of the lens unit further includes a plurality of posts each extending downward from the frame and parallel to the axis of the lens body.

16. The LED illumination device of claim 15, wherein the plate further includes at least one protrusion and at least one indentation at opposite edges thereof.

* * * * *